US006018147A

United States Patent [19]

Higgins

[11] Patent Number: 6,018,147

[45] Date of Patent: Jan. 25, 2000

[54] BASE FOR AN ELECTRIC HEATER AND METHOD OF MANUFACTURE

[75] Inventor: George Anthony Higgins, Stourbridge, United Kingdom

[73] Assignee: Ceramaspeed Limited, United Kingdom

[21] Appl. No.: 09/266,116

[22] Filed: Mar. 11, 1999

[30] Foreign Application Priority Data

Apr. 1, 1998 [GB] United Kingdom ..... 9806871

[51] Int. Cl.[7] ..... H05B 3/68; H05B 3/08; H01C 1/14

[52] U.S. Cl. ..... 219/461.1; 219/541; 338/332

[58] Field of Search ..... 219/460.1, 461.1, 219/462.1, 465.1, 466.1, 467.1, 541, 542, 544, 546; 338/312, 322, 323, 324

[56] References Cited

U.S. PATENT DOCUMENTS

| | | | |
|---|---|---|---|
| 3,567,906 | 3/1971 | Hurko | 219/461.1 |
| 3,749,883 | 7/1973 | Vodvarka et al. | 219/460.1 |
| 3,757,083 | 9/1973 | Dietz et al. | 219/541 |
| 3,833,793 | 9/1974 | McWilliams et al. | 219/461.1 |
| 3,991,298 | 11/1976 | Maake | 219/460.1 |
| 4,251,716 | 2/1981 | Lewis et al. | 219/460.1 |
| 4,253,012 | 2/1981 | Hughes | 219/461.1 |

*Primary Examiner*—Sang Paik
*Attorney, Agent, or Firm*—Ira S. Dorman

[57] ABSTRACT

A base for an electric heater comprises a base layer (13) of compacted insulation material (12) and a substantially U-shaped electrically conductive link (6) having upstanding leg portions (8, 9) with an elongate portion (7) extending therebetween. The link is embedded in the base layer with the leg portions protruding therefrom. The base layer (13) incorporates at least one recess (14) extending from a surface thereof to the elongate portion (7) of the link

8 Claims, 2 Drawing Sheets

1
2
5
9
3
10
6
7
4
8

11
12

11
13
9
7
6
14
8

BASE FOR AN ELECTRIC HEATER AND METHOD OF MANUFACTURE

This invention relates to a base for an electric heater and a method of manufacture. Such a base may be used in a radiant electric heater for a cooking appliance, which may be a glass-ceramic cooking appliance.

BACKGROUND TO THE INVENTION

Electric heaters of this kind are well known, having a base layer of insulation material in a support, such as of metal. At least one elongate electric heating element, such as of bare wire or ribbon form, is supported on the base layer.

When the heating element is provided of spiral form, extending from a periphery of the heater to a termination point within the heater, it is necessary to provide an electrically conducting link, such as of wire, strip or tape form, extending from the termination point to the periphery of the heater, for electrically connecting the heating element to a power supply.

A similar form of connecting link may also be required with any form of heating element which may have a termination within the heater or a tapping point intermediate the ends of the element and where it is necessary to provide an electrical connecting link between the termination or tapping point and the periphery of the heater.

It is known to provide a connecting link for this purpose in or under the insulation base of a heater. Such a link may be U-shaped, having an elongate portion with upstanding opposite end leg portions which are required to protrude from the surface of the insulation for connection purposes. Such a connecting link is known from European Patent Publication No. 0 630 169.

When the insulation base comprises compacted particulate material, such as microporous insulation material, it would be convenient and advantageous to embed such a link in the insulation base simultaneously with compacting particulate, that is powdered, insulation material into a dish-like support to form the base. A problem with this is that a link of wire, strip or tape form is not rigid and when held by the end leg portions and pressed into the insulation, during compaction thereof, it tends to bend in its elongate portion.

OBJECT OF THE INVENTION

It is an object of the present invention to overcome or minimise this problem.

SUMMARY OF THE INVENTION

According to one aspect of the present invention there is provided a method of manufacturing a base for an electric heater comprising the steps of:

providing a dish-like support;

providing a substantially U-shaped electrically conductive link having upstanding leg portions and an elongate portion extending between the upstanding leg portions;

providing a press tool having a major face provided with recesses for receiving the leg portions of the link, the press tool having at least one protrusion on the major face for contacting the elongate portion of the link intermediate the leg portions;

locating the link in the press tool with the leg portions received in the recesses and the elongate portion contacted by the at least one protrusion;

introducing powdered insulation material between the press tool and the dish-like support;

urging the press tool and the dish-like support towards each other to compact the insulation material into the dish-like support and embed the link in the insulation material with the leg portions protruding therefrom; and separating the press tool and the support.

The link may be of wire, strip or tape form.

The at least one protrusion on the major face of the press tool may have a surface provided with a groove for accommodating the elongate portion of the link.

The at least one protrusion may be tapered so as to be narrower at a region of contact with the elongate portion of the link than at a region in the vicinity of the major face of the press tool.

The at least one protrusion may be of substantially truncated conical form.

The at least one protrusion and/or the press tool may comprise a metal or a ceramic.

A plurality of protrusions may be provided, spaced apart along the elongate portion of the link.

The insulation material may comprise microporous insulation material.

The dish-like support may comprise a metal.

According to another aspect of the present invention there is provided a base for an electric heater comprising a base layer of compacted insulation material and a substantially U-shaped electrically conductive link having upstanding leg portions with an elongate portion extending therebetween, the link being embedded in the base layer with the leg portions protruding therefrom, wherein the base layer incorporates at least one recess extending from a surface thereof to the elongate portion of the link.

The link may be of wire, strip or tape form.

The at least one recess may be tapered so as to be wider at the surface of the insulation material than at the elongate portion of the link.

The at least one recess may be of substantially truncated conical form.

A plurality of recesses may be provided, spaced apart along the elongate portion of the link.

The insulation material may comprise microporous insulation material.

A dish-like support, such as of metal, may be provided for the base layer of compacted insulation material.

The base may be further processed by providing an elongate heating element supported on the base layer and electrically connecting a termination thereof to an upstanding leg portion of the link.

In the method of the invention, as a result of the location of the link in the press tool with the elongate portion of the link in contact with the one or more protrusions on the major face of the press tool, the link can be embedded in the insulation material without bending of the link occurring.

The invention is now described by way of example with reference to the accompanying drawings in which:

DESCRIPTION OF PREFERRED EMBODIMENT

Figure 1:
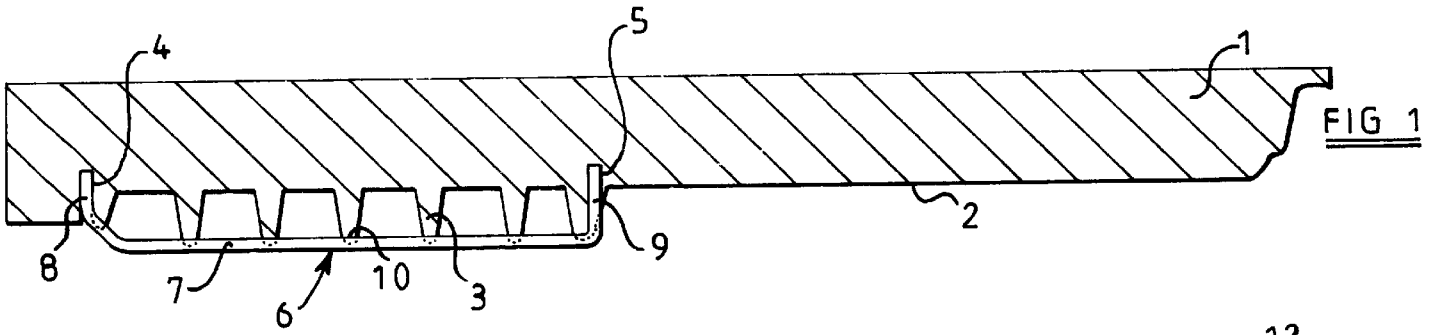
FIG. 1 is a cross-sectional view of a press tool with a located electrically conductive link.

As shown in FIG. 1, a press tool 1 is provided, such as of metal or ceramic, having a major face 2. A plurality of tapered protrusions 3, suitably of truncated conical form, are provided spaced apart in line on the major face 2 of the press tool and two recesses 4, 5, in the form of holes, are provided in the major face 2 in line with the protrusions 3.

A substantially U-shaped electrically conductive link 6 of wire, strip or tape form is provided, having an elongate portion 7 and upstanding opposite end leg portions 8 and 9. The link 6 is located in relation to the press tool 1 with the leg portions 8, 9 inserted in the recesses 4, 5 and with the elongate portion 7 in contact with the free ends 10 of the tapered protrusions 3. The free ends 10 of the tapered protrusions 3 are preferably grooved as illustrated by dashed lines in FIG. 1 to accommodate the profile of the link 6 and ensure reliable contact with the link.

Figure 2:
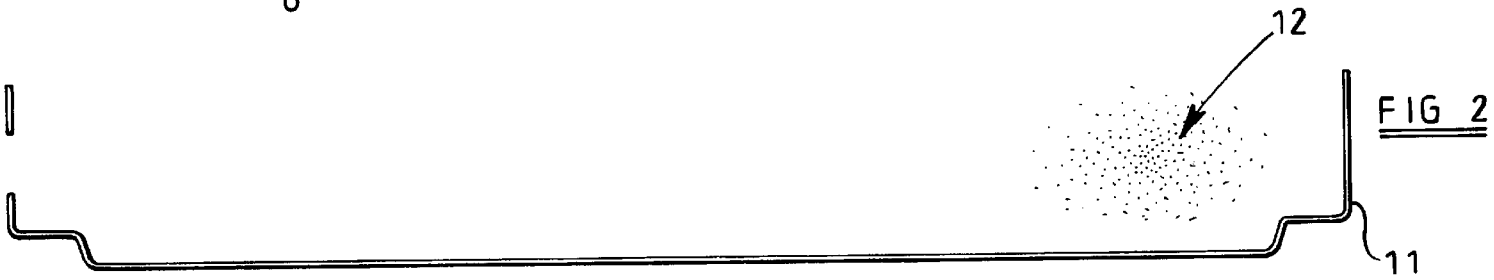
FIG. 2 is a cross-sectional view of a dish-like support for a base of an electric heater and into which insulation material is to be compacted with the press tool of FIG. 1 and the link of FIG. 1 embedded.

As shown in FIG. 2, a metal dish-like support 11 for the base of an electric heater is provided.

Figure 3:
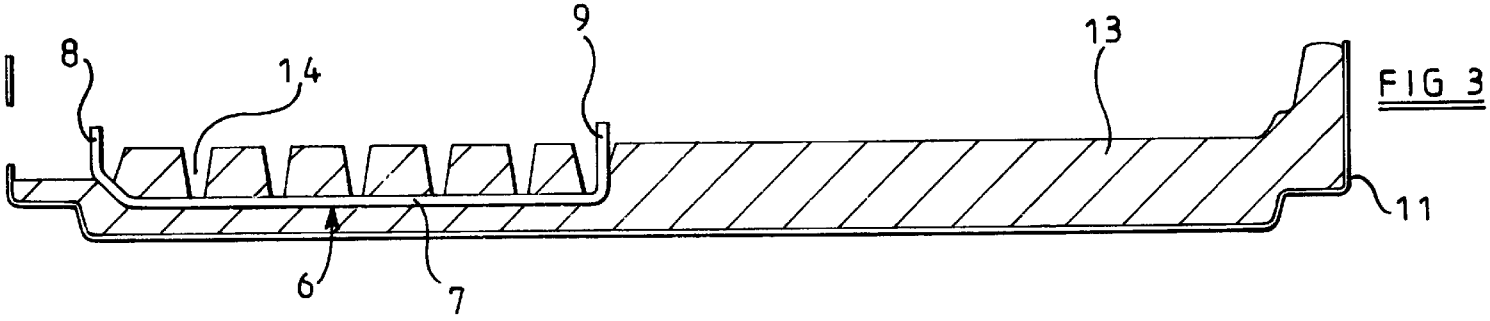
FIG. 3 is a cross sectional view of the base of the invention comprising the dish-like support of FIG. 2 having compacted insulation material therein and in which the link of FIG. 1 is embedded.

The dish-like support 11 of FIG. 2 and the press tool of FIG. 1 with the link in position are located between plates of a well known form of press (not shown) and powdered insulation material 12 is introduced between the press tool 1 and the dish-like support 11. The insulation material is suitably microporous insulation material, although other materials could be considered, such as powdered vermiculite or perlite. Mixtures of materials could also be used. The press is operated to urge the press tool 1 and the dish-like support 11 towards each other to compact the insulation material 12 into the dish-like support 11 and embed the link 6 into the insulation material. During this compaction and embedding process, contact between the protrusions 3 on the press tool and the elongate portion 7 of the link 6 prevents bending of the link from occurring. The press tool 1 and the dish-like support 11 are then separated leaving a base layer 13 of compacted insulation material in the dish-like support 11, as shown in FIG. 3, with the link 6 embedded therein. The leg portions 8 and 9 of the link extend from the surface of the base layer 13.

The conical form of the protrusions 3 on the press tool 1 allow the press tool to separate readily from the compacted base layer, leaving spaced apart clean recesses or holes 14 of complementary conical shape in the surface of the base layer 13 and with the link 6 exposed at the bottom of the recesses or holes. The recesses or holes 14 are tapered so as to be wider at the surface of the insulation material than at the elongate portion of the link.

Figure 4:
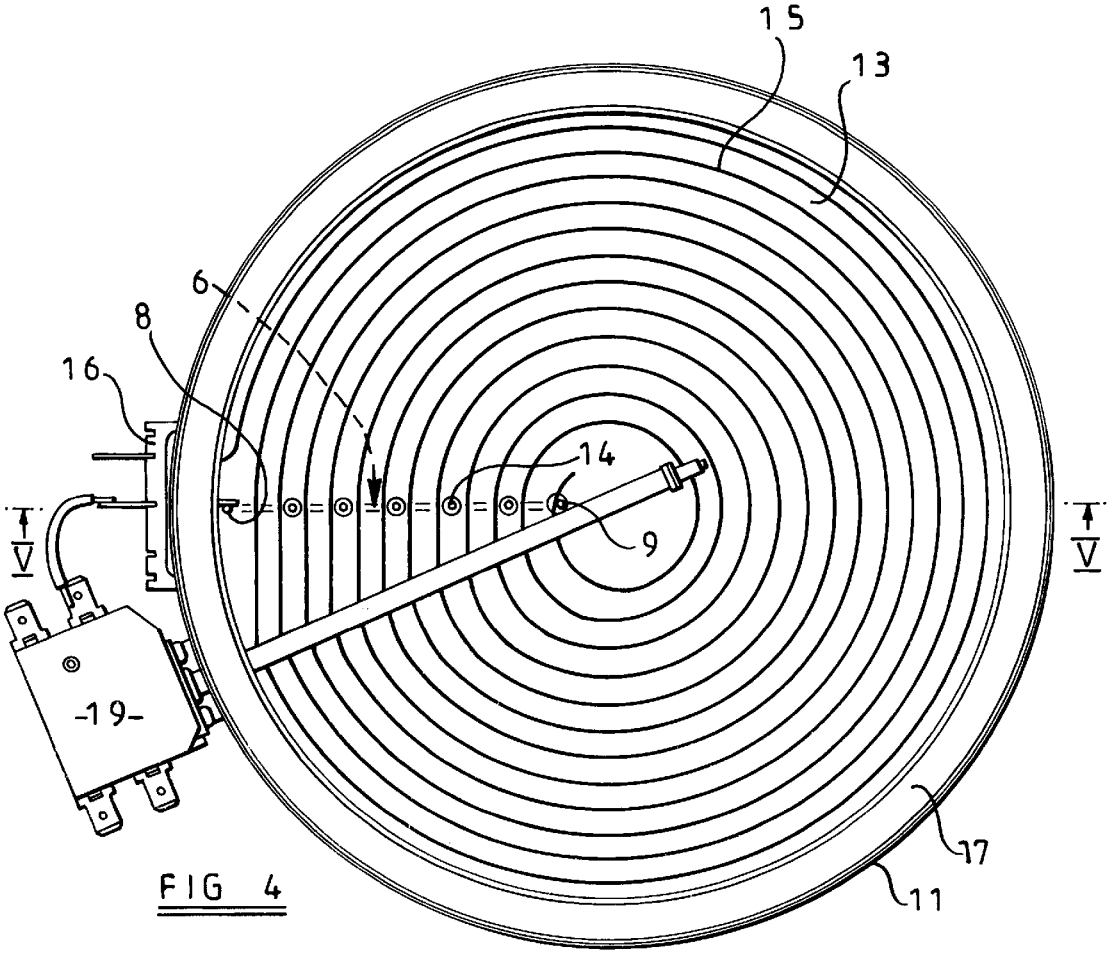
FIG. 4 is a plan view of an electric heater produced from the base and method of the invention.
Figure 5:
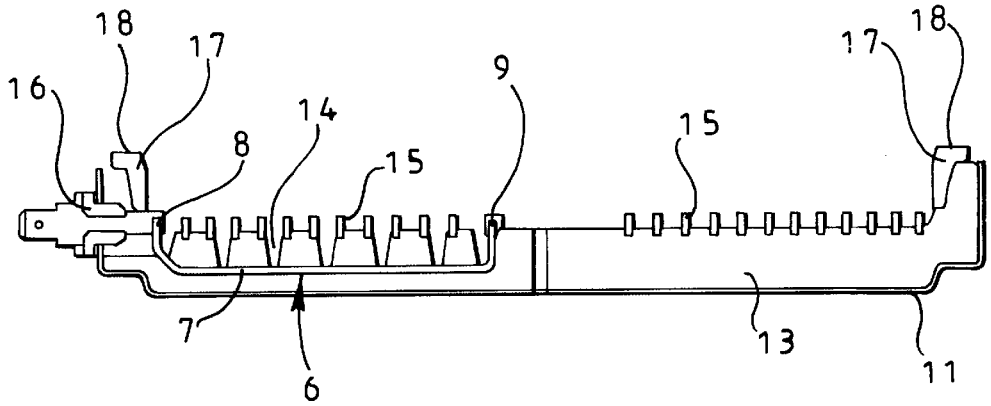
FIG. 5 is a cross-sectional view of the heater of FIG. 4.

An electric heater may then be completed from the resulting base, as shown in FIGS. 4 and 5. An electric heating element 15 of substantially spiral form is supported on the surface of the insulating base layer 13. As shown, this heating element comprises a ribbon which is supported on edge and partially embedded in the base layer 13. However other forms of heating element, such as coiled wire, could be provided.

One end of the heating element, at the periphery of the heater, is connected to a terminal in a terminal block 16. The other end of the heating element, remote from the periphery of the heater, is connected to one upstanding leg portion 9 of the link 6, such as by welding. The other upstanding leg portion 8 of the link 6 is situated at the periphery of the heater and is connected to a terminal in the terminal block 16, such as by welding.

A peripheral wall 17 of insulation material, such as vermiculite, is provided on the heater and has an upper surface 18 adapted to contact a plate, such as a glass-ceramic plate (not shown) in a cooking appliance.

A well-known form of rod-like temperature-responsive device 19 is provided to prevent overheating and/or for providing control of the heater.

Although in the foregoing description specific reference has been made to a heating element of substantially spiral shape the invention is not limited thereto but is applicable wherever there is a requirement to provide a connecting link between a termination or tapping point on one or more heating elements, of whatever shape, within a heater, and a peripheral region of the heater. The invention is applicable to heaters having a plurality of heating elements, such as in concentric arrangement, and where it is required to connect an end or ends of one or more such elements within the heater to a terminal location at the periphery of the heater.

I claim:

1. A base for an electric heater comprising a base layer of compacted insulation material and a substantially U-shaped electrically conductive link having upstanding leg portions with an elongate portion extending therebetween, the link being embedded in the base layer with the leg portions protruding therefrom, wherein the base layer incorporates at least one recess extending from a surface thereof to the elongate portion of the link.

2. A base according to claim 1, wherein the link is selected from wire, strip and tape form.

3. A base according to claim 1, wherein the at least one recess is tapered so as to be wider at the surface of the insulation material than at the elongate portion of the link.

4. A base according to claim 3, wherein the at least one recess is of substantially truncated conical form.

5. A base according to claim 1, wherein a plurality of recesses are provided, spaced apart along the elongate portion of the link.

6. A base according to claim 1, wherein the insulation material comprises microporous insulation material.

7. A base according to claim 1, wherein a dish-like support is provided for the base layer of compacted insulation material.

8. A base according to claim 7, wherein the dish-like support comprises a metal.

* * * * *